United States Patent [19]

Maeda et al.

[11] 4,090,353

[45] May 23, 1978

[54] TOUCH SWITCH CONTROLLED TIME INFORMATION CORRECTION WITH SAFETY LOCK IN AN ELECTRONIC WRISTWATCH

[75] Inventors: Hidetoshi Maeda, Tenri; Takehiko Sasaki, Yamatokoriyama, both of Japan

[73] Assignee: Sharp Kabushiki Kaisha, Osaka, Japan

[21] Appl. No.: 647,891

[22] Filed: Jan. 9, 1976

[30] Foreign Application Priority Data

Jan. 10, 1975 Japan ..... 50-5838
Jan. 18, 1975 Japan ..... 50-8172

[51] Int. Cl.[2] ..... G04C 3/00; G04B 19/30; G04B 27/00

[52] U.S. Cl. ..... 58/85.5; 58/23 R; 58/50 R; 58/91; 307/116

[58] Field of Search ..... 58/23 R, 50 R, 85.5, 58/91; 200/DIG. 2, 159 B; 307/116, 117

[56] References Cited

U.S. PATENT DOCUMENTS

| | | | |
|---|---|---|---|
| 3,322,485 | 5/1967 | Williams | 350/160 |
| 3,754,130 | 8/1973 | Stone | 58/50 R |
| 3,768,247 | 10/1973 | Fujita | 58/50 R |
| 3,803,834 | 4/1974 | Reese | 58/152 R |
| 3,817,021 | 6/1974 | Bergey | 58/85.5 |
| 3,823,545 | 7/1974 | Vittoz et al. | 58/85.5 |
| 3,871,168 | 3/1975 | Maire et al. | 58/85.5 |
| 3,871,170 | 3/1975 | Bergey | 58/50 R |
| 3,943,696 | 3/1976 | Portmann et al. | 58/23 R |
| 3,944,843 | 3/1976 | Martias | 307/116 |
| 3,953,963 | 5/1976 | Nishimura et al. | 58/85.5 |

OTHER PUBLICATIONS

R. A. Johnson, *IBM Technical Disclosure Bulletin* Push Button Switch with no moving Parts, Apr., 1971, vol. 13, No. 11 p. 3551.

*Primary Examiner*—Edith S. Jackmon
*Attorney, Agent, or Firm*—Birch, Stewart, Kolasch & Birch

[57] ABSTRACT

Transparent touch electrodes are formed on a front glass window of an electronic wristwatch at positions near, for example, the hour information digital display section and the minute information digital display section for correcting the time information in terms of hours and minutes, respectively. A safety lock system associated with the touch electrodes is provided to prevent the time information correction when it is not desired. The safety lock system counts an intermittent touch operation effected on the touch electrodes, thereby allowing the introduction of a time information correction command only when the touch operation is repeated over a predetermined number of times within a predetermined time period.

7 Claims, 7 Drawing Figures

TOUCH SWITCH CONTROLLED TIME INFORMATION CORRECTION WITH SAFETY LOCK IN AN ELECTRONIC WRISTWATCH

BACKGROUND AND SUMMARY OF THE INVENTION

The present invention relates to an electronic wristwatch and, more particularly, to a touch switch mechanism in an electronic wristwatch.

In a conventional electronic wristwatch, a mechanical switch such as a pushbutton switch was installed on a frame to correct the time information stored in the electronic wristwatch and displayed on a display panel. The mechanical switch, however, unavoidably took up large space and the mechanical switch was worn down with the lapse of time.

To avoid the above-mentioned defectives, it has been proposed to provide an electronic switch, or, a touch switch mechanism in an electronic wristwatch. Although it is not preferable, there is a possibility that the touch switch mechanism operates when it is not desired by an erroneous touch by the operator.

Accordingly, an object of the present invention is to provide a time information correction system controlled by a touch switch mechanism in an electronic wristwatch.

Another object of the present invention is to provide a safety lock system of a touch switch mechanism in an electronic wristwatch.

Still another object of the present invention is to provide an electronic wristwatch including an electronic safety lock system of a touch switch mechanism.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to the present invention, transparent touch electrodes made of, for example, indium oxide or stannic oxide are formed on a front glass window of an electronic wristwatch at positions near the hour information digital display section and the minute information digital display section for correcting the time information in terms of hours and minutes, respectively. The minute information and the hour information is increased by one every one second during the time peiod when the operator touches the respective transparent touch electrodes.

An electronic safety lock system associated with the touch electrodes is provided to prevent the time information correction when it is not desired. The electronic safety lock system counts an intermittent touch operation effected on the touch electrodes, thereby allowing the introduction of a time information correction command only when the touch operation is repeated over a predetermined number of times within a predetermined time period.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
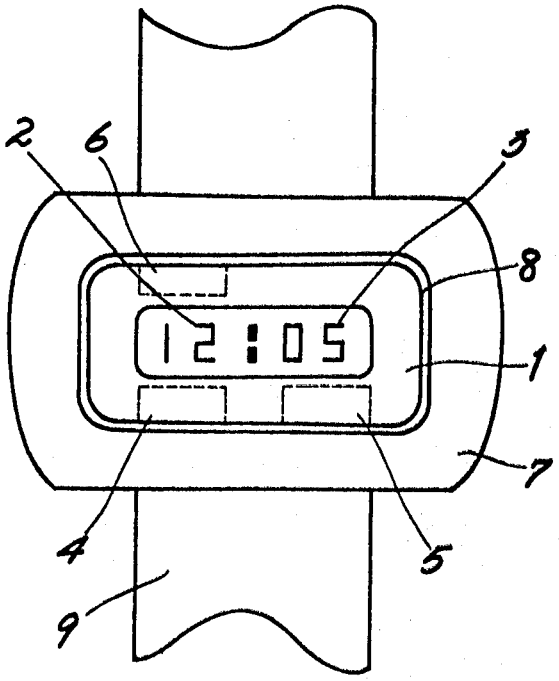
FIG. 1 is a plan view of an embodiment of an electronic wristwatch of the present invention.

Referring now to FIG. 1, there is illustrated an embodiment of an electronic wristwatch of the present invention, an hour information correction touch electrode 4, a minute information correction touch electrode 5 and a reset touch electrode 6 are formed on a front glass window 1. The hour information correction touch electrode 4 is positioned near an hour information display section 2, whereas the minute information correction touch electrode 5 is positioned near a minute information display section 3. The touch electrodes 4, 5 and 6 are electrically connected to the interior of the electronic wristwatch without being connected to a front metal frame 7 by the provision of an insulation film 8. The insulation film 8 is installed between the front glass window 1 and the front metal frame 7 and functions not only as the insulator but also as the packing. A belt 9 is attached to the body of the electronic wristwatch to secure the electronic wristwatch around the operator's wrist.

Figure 2:
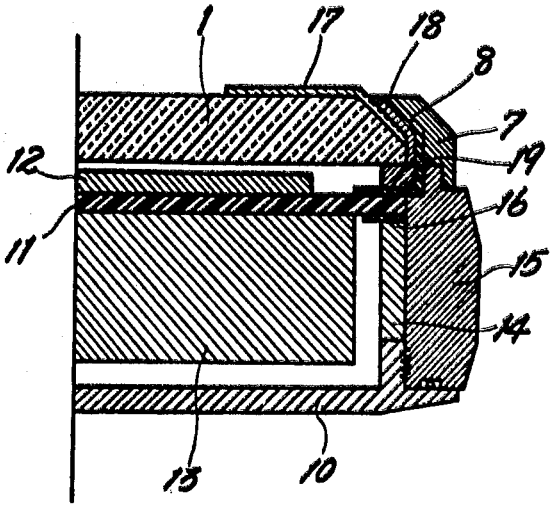
FIG. 2 is a cross-sectional view of the electronic wristwatch of FIG. 1.

FIG. 2 shows a typical construction of the electronic wristwatch. A rear metal frame 10 is provided at the back of the electronic wristwatch. The rear metal frame 10 is kept in contact with the operator's wrist in its operative condition and acts as another electrode for the touch switch mechanism. A substrate 11 made of ceramics or resin is provided for supporting a display unit 12 on its upper surface and a movement 13 on its rear surface. Electrical connection between the rear metal frame 10 and the movement 13 is achieved through an internal frame 14 made of metal and/or a casing 15 made of metal, and a metal leaf 16 attached to the rear surface of the substrate 11.

The upper surface of the front glass window 1 is coated with thin-film transparent electrodes 17 through the use of vacuum evaporation technique, the thin-film transparent electrodes 17 forming the touch electrodes 4, 5 and 6. The thin-film transparent electrodes 17 are usually made of indium oxide or stannic oxide and are tightly attached to the front glass window 1 and, therefore, they can not be easily peeled off. The thin-film transparent electrodes 17 (the touch electrodes 4, 5 and 6) are electrically connected to the movement 13 through conductive rubber frames 18, which also act as an water-proof packing, and metal leaves 19. The insulation film 8 is installed between the conductive rubber frames 18 and the front metal frame 7 for electrically insulating the thin-film transparent electrodes 17 (the touch electrodes 4, 5 and 6) and the conductive rubber frames 18 from the front metal frame 7 and the casing 15 made of metal. The conductive rubber frames 18 and the insulation film 8 can be constructed in a single body, thereby facilitating the fabrication of the electronic wristwatch.

First of all, the switching mechanism of the electronic touch switch system will be described with reference to FIGS. 3 and 4.

Figure 3:
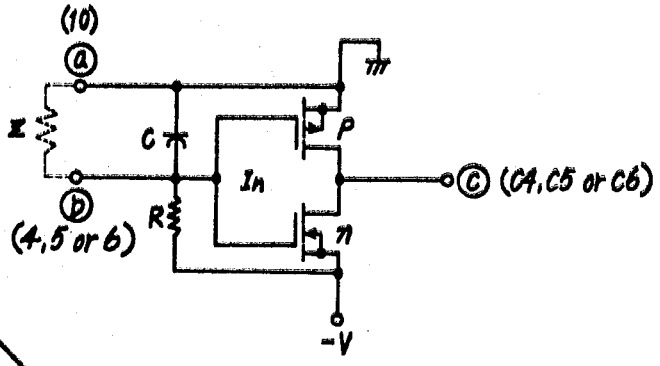
FIG. 3 is a circuit diagram of an embodiment of a touch switch mechanism included within the electronic wristwatch of FIG. 1.

In FIG. 3, a point a corresponds to the rear metal frame 10, whereas a point b corresponds to the touch electrode 4, 5 or 6. A switching circuit comprises a C-MOS inverter $I_n$ which has two input terminals a and b associated with the rear metal frame 10 and the touch electrode 4, 5 or 6, respectively.

When the electric circuit between the points a and b is in the open condition, the gate input of the C-MOS inverter $I_n$ is connected to a negative voltage souce $-V$ through a resistor R of high resistance. The gate input can be maintained at a low level logic value "0") even though the electrical path is shunted throuch the high resistor R (in principle $R \leqq 10^{12}\Omega$), since the input impedance of the C-MOS inverter $I_n$ is usually around $10^{12}\Omega$. Accordingly, the gate input of the C-MOS inverter $I_n$ can be assumed to be usually maintained at the low level (logic value "0") by the high resistor R.

Figure 4:
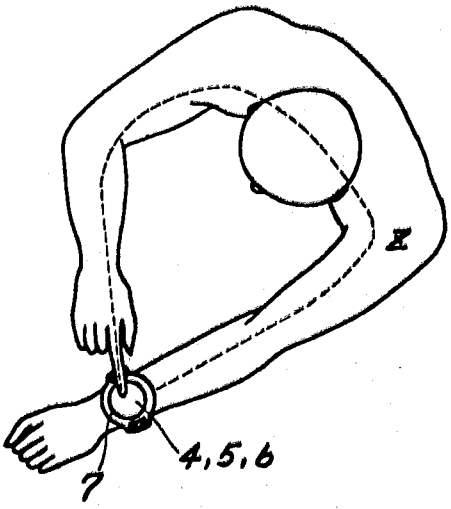
FIG. 4 is a schematic view showing an operation mode of the electronic wristwatch of FIG. 1.

When the operator touches the point b, the points a and b are connected with each other through a resistor Z which is caused by the operator's body, as shown in FIG. 4. The gate input level $V_G$ is identical with the voltage value divided by the resistors Z and R, and can be expressed as follows:

$$, V_G = -R/Z + R\,V \quad (1)$$

When the gate input level $V_G$ exceeds the threshold level $V_T$ of the C-MOS inverter $I_n$, the gate input changes from its low level (logical value "0") to its high level (logical value "1"). It will be noted that the condition of the inversion is as follows:

$$V_G > V_T \quad (2)$$

The threshold level $V_T$ of the C-MOS inverter $I_n$ unavoidably varies depending upon the individual makes of the C-MOS inverters. Now assume that;

$$V_T = -0.7V \quad (3)$$

The following relation can be derived from the expressions (1), (2) and (3).

$$R/Z + R > 0.7 \quad (4)$$

i.e.

$$R > 2.3Z \quad (5)$$

When the input impedance of the C-MOS inverter $I_n$ is represented as $Z_{in}$, the condition of the inversion of the gate input from its high level (logical value "1") to its low level (logical value "0") can be expressed as follows:

$$V_G = -R/Z_{in} + R\,V \quad (6)$$

$$V_T > V_G \quad (7)$$

$$V_T = -0.3V \quad (8)$$

Therefore, the following expression can be derived from the expressions (6), (7) and (8).

$$R/Z_{in} + R < 0.3 \quad (9)$$

i.e.

$$R < 0.4Z_{in} \quad (10)$$

When the resistance value Z of the operator's body is $5 \times 10^6\Omega$, the resistance value R in the expression (5) can be calculated as follows:

$$R > 2.3 \times 5 \times 10^6 = 11.5 \times 10^6\,(\Omega) \quad (11)$$

When the input impedance $Z_{in}$ is $10^{12}\Omega$, the resistance value R in the expression (10) can be calculated as follows:

$$R < 4 \times 10^{11}\,(\Omega) \quad (12)$$

It will be clear from expressions (11) and (12) that the switching mechanism can be performed by the C-MOS inverter $I_n$ when the resistance value R of the high resistor is selected around $20 \times 10^6\Omega$.

In the circuit of FIG. 3, a capacitor C cooperates with the high resistor R to form a low-pass filter, thereby preventing the entrance of the induced noise.

Although the above-mentioned electronic touch switch system employs the C-MOS inverter $I_n$, the electronic touch switch system can be constructed with the use of a C-MOS exclusive OR gate. A typical electronic touch switch system comprising the C-MOS exclusive OR gate is disclosed in our copending U.S. Pat. application Ser. No. 575,731 filed on May 8, 1975 and entitled "SWITCHING MECHANISM FOR ELECTRONIC WRISTWATCH".

Figure 5:
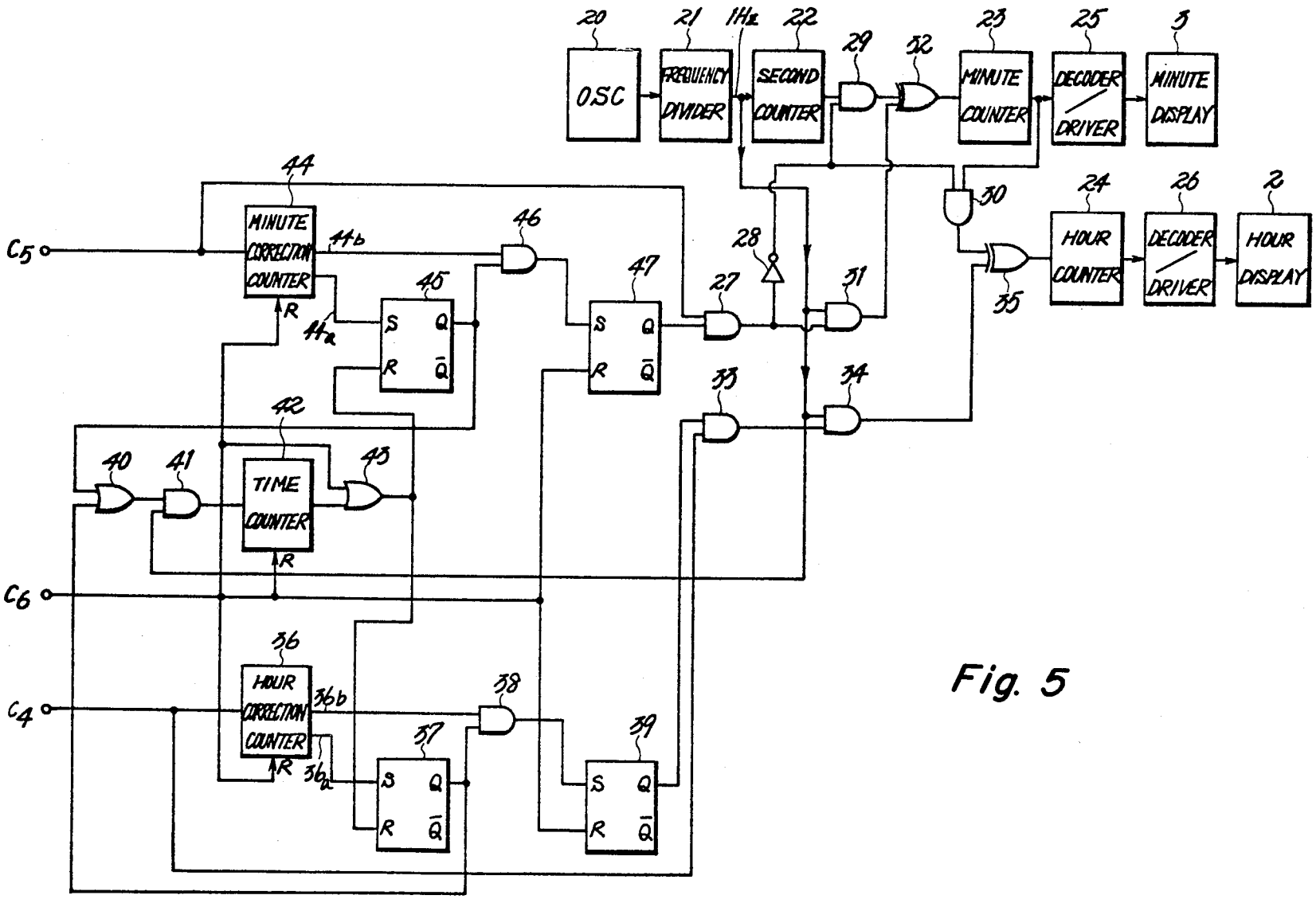
FIG. 5 is a circuit diagram of a time information correction system of the electronic wristwatch of FIG. 1.

Referring now to FIG. 5, there is illustrated a circuit diagram of a time information correction system of the present invention, wherein a terminal $C_4$ corresponds to a terminal c of FIG. 3 when the terminal b of FIG. 3 corresponds to the hour information correction touch electrode 4, a terminal $C_5$ corresponds to the terminal c of FIG. 3 when the terminal b of FIG. 3 corresponds to the minute information correction touch electrode 5, and a terminal $C_6$ corresponds to the terminal c of FIG. 3 when the terminal b of FIG. 3 corresponds to the reset touch electrode 6, respectively. Respective input signals to the terminals $C_4$, $C_5$ and $C_6$ have, in their normal conditions, the logic values "0", whereas the input signals to the terminals $C_4$, $C_5$ and $C_6$ take the logic values "1" when the operator touches the hour information correction touch electrode 4, the minute information correction touch electrode 5, and the reset touch electrode 6, respectively.

A base frequency signal generated from a base signal generator 20 is frequency divided by a frequency divider 21 to develop a reference signal of one hertz. The reference signal is sequentially applied to a second information counter 22, a minute information counter 23 and an hour information counter 24. The time information stored in the minute information counter 23 is displayed on the minute information display section 3 via a minute information decoder/driver circuit 25, whereas the time information stored in the hour information counter 24 is displayed on the hour information display section 2 via an hour information decoder/driver circuit 26.

When an output of an AND gate 27 is "1", an output of an inverter 28 is "0" and, hence, AND gates 29 and 30 are maintained OFF, thereby inhibiting the normal counting operation of the minute information counter 23 and the hour information counter 24. At the same time, the output "1" of the AND gate 27 renders an AND gate 31 ON and, therefore, the AND gate 31 outputs the reference signal of one hertz developed from the frequency divider 21. The reference signal of one hertz is applied to the minute information counter 23 via an exclusive OR gate 32, thereby to rapidly advance the minute information counter 23. In a same manner, when an output of an AND gate 33 is "1", an AND gate 34 is maintained ON and, therefore, the AND gate 34 develops the reference signal of one hertz derived from the frequency divider 21. The reference signal of one hertz is applied to the hour information counter 24 via an exclusive OR gate 35, thereby to rapidly advance the hour information counter 24. During the correction operation of the hour information, the minute information counter 23 performs the normal counting operation.

The signal from the terminal $C_4$ is applied to an hour information correction counter 36. The hour information correction counter 36 develops two output signals **36*a* and 36*b*, one output signal 36*a* taking the logic value "1" only when the content of the hour information correction counter 36 is "1", and the other output signal 36*b* bearing the logic value "1" only when the content of the hour information correction counter 36 is "5". The output signal 36*a* is applied to the set terminal S of an SR flip-flop 37. A logic product of the Q output of the SR flip-flop 37 and the said output signal 36*b* is applied to the set terminal S of an SR flip-flop 39 through an AND gate 38. The Q output signal of the SR flip-flop 39 and the signal from the terminal $C_4$ are applied to the said AND gate 33**.

The Q output signal of the SR flip-flop 37 is applied to one input terminal of an AND gate 41 via an OR gate 40. The other input terminal of the AND gate 41 is connected to receive the reference signal of one hertz developed from the frequency divider 21. An output signal of the AND gate 41 is applied to a time counter 42, of which an output signal takes the logic value "1" only when the content of the time counter 42 is "5". The output signal of the time counter 42 is applied to the reset terminal R of the flip-flop 37 through an OR gate 43.

The signal from the terminal $C_5$ is applied to a minute information correction counter 44. The minute information correction counter 44 develops two output signals **44*a* and 44*b*, one output signal 44*a* taking the logic value "1" only when the content of the minute information correction counter 44 is "1", whereas the other output signal 44*b* bearing the logic value "1" only when the content of the minute information correction counter 44 is "5". The output signal 44*a* is applied to the set terminal S of an SR flip-flop 45. A logic product of the Q output signal of the SR flip-flop 45 and the output signal 44*b* of the minute information correction counter 44 is applied to the set terminal S of an SR flip-flop 47 through an AND gate 46. The Q output signal of the SR flip-flop 47 and the signal from the terminal $C_5$ are applied to the AND gate 27. The Q output signal of the SR flip-flop 45 is applied to the one input terminal of the AND gate 41 via the OR gate 40. The reset terminal R of the SR flip-flop 45 is connected to receive the output signal of the OR gate 43**.

The reset signal from the terminal $C_6$ is applied to the reset terminals R of the hour information correction counter 36, the time counter 42, the minute information correction counter 44 and the SR flip-flops 39 and 47. The reset signal from the terminal $C_6$ is also applied to the reset terminals R of the SR flip-flops 37 and 45 through the OR gate 43.

The operation mode of the hour information correction will be described with reference to FIG. 5. The operation mode of the minute information correction has been omitted from the description for the purpose of simplicity, since it will be understood from the description relating to the operation mode of the hour information correction given hereinbelow.

When the operator touches the hour information correction touch electrode 4, the signal from the terminal $C_4$ takes the logic value "1". The content of the hour information correction counter 36 becomes one and, hence, the output signal **36*a* of the hour information correction counter 36 bears the logic value "1", thereby setting the SR flip-flop 37 to render the Q output signal of the flip-flop 37 "1". Under these conditions, the one input signal to the AND gate 38 takes the logic value "1", but the other input signal 36*b* to the AND gate 38 takes the logic value "0" and, therefore, the AND gate 38 is kept OFF. The Q output signal of the flip-flop 37 renders the AND gate 41 ON via the OR gate 40, whereby the reference signal of one hertz is applied to the time counter 42 through the AND gate 41**.

The output signal of the time counter 42 takes the logic value "1" when the content of the time counter 42 is five, whereas the output signal **36*b* of the hour information correction counter 36 bears the logic value "1" when the content of the hour information correction counter 36 is five. Therefore, the operation mode changes depending upon the fact of whether the operator touches the hour information correction touch electrode 4** more than five times within 5 seconds.

(A) When the operator touches the hour information correction touch electrode 4 more than five times within 5 seconds:

The content of the hour information correction counter 36 becomes one when the operator once touches the hour information correction touch electrode 4. The output **36*a* of the hour information correction counter 36 is "1" and, therefore, the Q output of the SR flip-flop 37 becomes "1". The Q output signal of the SR flip-flop 37 renders the one input signal of the AND gate 38 "1", and renders the one input signal of the AND gate 41 "1" through the OR gate 40. Therefore, the reference signal of one hertz is applied to the time counter 42 through the AND gate 41, whereby the time counter 42 begins to count up the reference signal of one hertz. When the content of the time counter 42 becomes five, namely, when 5 seconds pass, the output signal of the time counter 42 becomes "1" and, hence, the SR flip-flop 37 is reset through the OR gate 43, whereby the AND gate 38 becomes its OFF condition. However, in the case of (A), the content of the hour information correction counter 36 becomes five before the SR flip-flop 37 is reset and, therefore, the SR flip-flop 39 is set through the AND gate 38 because the output signal 36*b* of the hour information correction counter 36 becomes "1". Even though the flip-flop 37 is reset when 5 seconds pass, the flip-flop 39 is maintained in its set condition before the operator touches the reset touch electrode 6. Under the condition where the flip-flop 39** is set, when the operator continuously touches the hour information correction touch electrode 4, the AND gate 33 becomes ON by the Q output signal of the SR flip-flop 39 and the signal from the terminal $C_4$. Therefore, the hour information in the hour information counter 24 is rapidly advanced by the reference signal of one hertz during a time period when the operator touches the hour information correction touch electrode 4.

(B) When the operator does not touch the hour information correction touch electrode 4 more than five times within 5 seconds:

In this case, the SR flip-flop 37 is reset because the output signal of the time counter 42 becomes "1" before the output signal 36*b* of the hour information correction counter 36 becomes "1". Therefore, the AND gate 38 is maintained OFF and, hence, the SR flip-flop 39 is not set.

It will be clear from the foregoing description that the SR flip-flop 39 functions as a safety lock. To unlock the above safety lock, the operator must touch the hour information correction touch electrode 4 more than five times within 5 seconds. Therefore, the hour information will not be changed when it is not desired, or, the hour information will not be changed by an erroneous touch to the hour information correction touch electrode 4.

In the foregoing embodiment, the safety lock is released through the use of the hour information correction touch electrode or the minute information correction touch electrode. Contrarily, a safety lock release touch electrode can be formed on the front glass window of the electronic wristwatch in addition to the hour information correction touch electrode and the minute information correction touch electrode.

Figure 6:
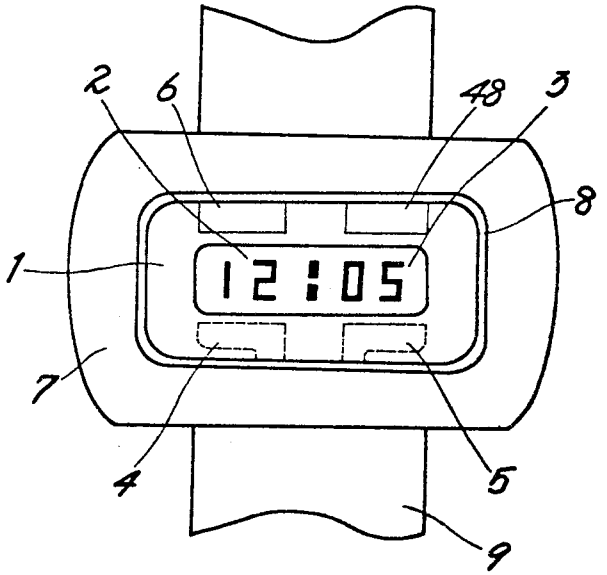
FIG. 6 is a plan view of another embodiment of an electronic wristwatch of the present invention.

FIG. 6 shows another embodiment of an electronic wristwatch of the present invention. A safety lock release touch electrode 48 is formed on the front glass window 1 in addition to the hour information correction touch electrode 4, the minute information correction touch electrode 5 and the reset touch electrode 6. A safety lock flip-flop is provided and connected to receive a signal from the safety lock release touch electrode 48. The safety lock flip-flop is set when the operator touches the safety lock release touch electrode 48 more than five times within five seconds, thereby allowing the introduction of the signal from the hour information correction touch electrode 4 and the minute information correction touch electrode 5.

Figure 7:
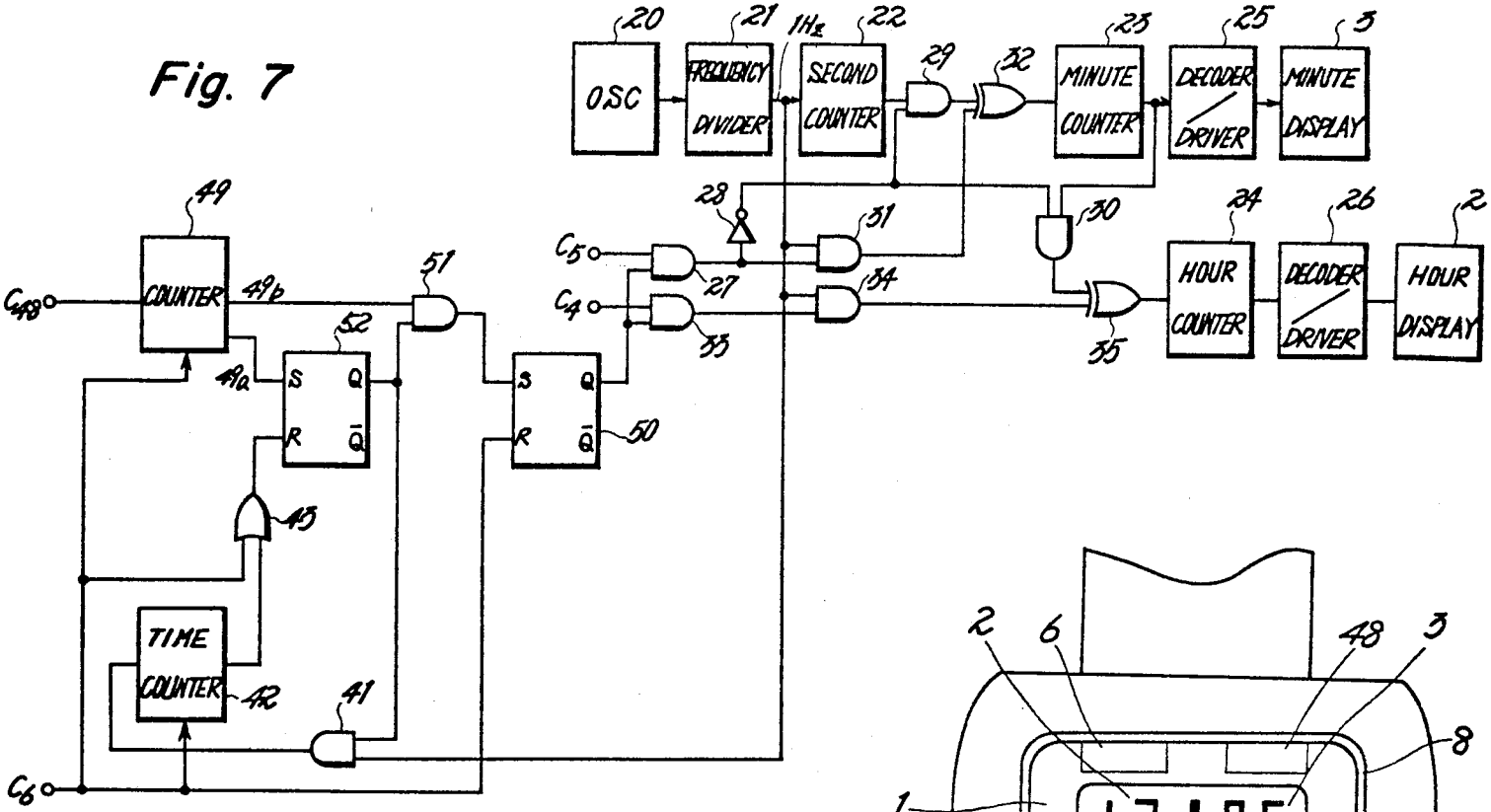
FIG. 7 is a circuit diagram of a time information correction system of the electronic wristwatch of FIG. 6.

A typical circuit construction embodying the electronic wristwatch of FIG. 6 is shown in FIG. 7. Like elements corresponding to those of FIG. 5 are indicated by like numerals. A terminal $C_{48}$ corresponds to the terminal c of FIG. 3 when the terminal b of FIG. 3 corresponds to the safety lock release touch electrode 48. A safety lock signal is introduced into a counter 49 via the terminal $C_{48}$, namely, the safety lock release touch electrode 48. The counter 49 operates in a same manner as the hour information correction counter 36 of FIG. 5. When the operator touches the safety lock release touch electrode 48 more than five times within five seconds, an RS flip-flop 50 is set through an RS flip-flop 52 and an AND gate 51. The Q output signal of the RS flip-flop 50 controls the conditions of the AND gates 27 and 33. The other input terminals of the AND gates 27 and 33 are directly connected to the terminals $C_5$ and $C_4$, respectively. It will be clear that the time information correction signal can not be introduced into the system from the hour information correction touch electrode 4 or the minute information correction touch electrode 5 unless the RS flip-flop 50 is set through the use of the safety lock release touch electrode 48.

In the system of FIG. 5, the output signal of the OR gate 43 is applied to the reset terminals R of the flip-flops 37 and 45. The output signal of the OR gate 43 can also be applied to the reset terminals R of the hour information correction counter 36 and the minute information correction counter 44, whereby the hour information correction counter 36 and the minute information correction counter 44 is reset when the touch electrode 4 or 5 is touched less than four times within five seconds.

In the embodiment of FIG. 5, it is preferable that the operator touches, at first, the reset touch electrode 6 to reset the hour information correction counter 36 and the minute information correction counter 44 and, thereafter, touches the hour information correction touch electrode 4 or the minute information correction touch electrode 5.

In the embodiment of FIG. 7, it is preferable that the counter 49 develops another output signal of logic value "1" when the content of the counter 49 is six. This output signal can be used to reset the flip-flop 50, whereby the safety lock system is released when the operator touches the safety lock release touch electrode 48 five times within five seconds and the safety lock system is again locked when the operator once again touches the safety lock release touch electrode 48 in the condition where the safety lock system is released.

The invention being thus described, it will be obvious that the same way be varied in many ways. Such variations are not to be regarded as a departure from the spirit and scope of the invention, and all such modifications are intended to be included within the scope of the following claims.

What is claimed is:

1. In an electronic wristwatch which comprises a casing including a front glass window, a time information calculation circuit, an hour information display unit covered by the front glass window and a minute information display unit covered by the front glass window, the improvement comprising:

a. an hour information correction touch electrode for correcting the hour information displayed on the hour information display unit;

b. a minute information correction touch electrode for correcting the minute information displayed on the minute information display unit;

c. safety lock means for inhibiting the hour information correction operation and the minute information correction operation when it is not desired; and d. release means for releasing said safety lock means to preclude operation of said safety lock means, wherein said release means includes means for releasing the safety lock means when the hour information correction touch electrode or the minute information correction touch electrode is touched more than a predetermined mumber of times within a predetermined time period.

2. The electronic wristwatch of claim 1, wherein the hour information correction touch electrode is formed on the front glass window near the hour information display unit and the minute information correction touch electrode is formed on the front glass window near the minute information display unit.

3. The electronic wristwatch of claim 2, wherein the hour information correction touch electrode and the minute information correction touch electrode are from a group consisting of indium oxide and stannic oxide.

4. The electronic wristwatch of claim 1, wherein the hour information correction circuit and the minute information correction circuit are connected to receive a reference signal of one hertz to increment the hour information and the minute information by one every one second.

5. The electronic wristwatch of claim 1, which further comprises a reset touch electrode for resetting the safety lock means.

6. In an electronic wristwatch which comprises a casing including a front glass window, a time information calculation circuit, an hour information display unit covered by the front glass window and a minute information display unit covered by the front glass window, the improvement comprising:

a. an hour information correction touch electrode for introducing an hour information correction command;

b. an hour information correction circuit for rapidly advancing hour information in response to the hour information correction command;

c. a minute information correction touch electrode for introducing a minute information correction command;

d. a minute information correction circuit for rapidly advancing minute information in response to the minute information correction command;

e. safety lock means for inhibiting the introduction of the hour information correction command and the minute information correction command when it is not desired; and f. release means for releasing the safety lock means when the hour information correction touch electrode or the minute information correction touch electrode is touched more than a predetermined number of times within a predetermined time period.

7. The electronic wristwatch of claim 6, which further comprises a reset touch electrode for resetting the safety lock means.

* * * * *